US008919604B2

(12) United States Patent
Bergman et al.

(10) Patent No.: US 8,919,604 B2
(45) **Date of Patent: *Dec. 30, 2014**

(54) HAND-HELD VESSEL WITH ADJUSTABLE STRAP

(71) Applicant: Bercom International, LLC, Chanhassen, MN (US)

(72) Inventors: Mark W. Bergman, Minnetonka, MN (US); Matthew V. Leyden, St. Paul, MN (US); Jeffrey B. Waffensmith, North Oaks, MN (US)

(73) Assignee: Bercom International, LLC, Chanhassen, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/028,892

(22) Filed: Sep. 17, 2013

(65) Prior Publication Data

US 2014/0014670 A1 Jan. 16, 2014

Related U.S. Application Data

(60) Continuation of application No. 12/685,266, filed on Jan. 11, 2010, now Pat. No. 8,556,116, which is a continuation of application No. 11/085,457, filed on Mar. 21, 2005, now Pat. No. 7,644,835, which is a division of application No. 10/730,691, filed on Dec. 8, 2003, now Pat. No. 6,991,829, which is a division of application No. 09/961,090, filed on Sep. 21, 2001, now Pat. No. 6,708,838.

(60) Provisional application No. 60/234,617, filed on Sep. 22, 2000, provisional application No. 60/262,165, filed on Jan. 16, 2001, provisional application No. 60/287,332, filed on Apr. 30, 2001.

(51) Int. Cl.
*B65D 25/28* (2006.01)

(52) U.S. Cl.
USPC ..... 220/754; 220/757; 220/759; 220/770

(58) Field of Classification Search
USPC ..... 220/759, 764, 636, 754, 757, 770
See application file for complete search history.

(56) References Cited

U.S. PATENT DOCUMENTS

| | | | | | |
|---|---|---|---|---|---|
| 3,014,621 | A | * | 12/1961 | Povitz | 222/183 |
| 3,107,028 | A | * | 10/1963 | De Robertis | 220/212 |
| 3,115,916 | A | * | 12/1963 | Stephens | 241/199.12 |
| 3,920,147 | A | * | 11/1975 | Hiatt | 220/756 |
| 5,269,095 | A | * | 12/1993 | Helfman et al. | 47/65.5 |
| 5,413,231 | A | * | 5/1995 | Carroll et al. | 215/396 |
| 6,708,838 | B2 | * | 3/2004 | Bergman et al. | 220/757 |
| 8,556,116 | B2 | * | 10/2013 | Bergman et al. | 220/770 |

* cited by examiner

*Primary Examiner* — Stephen Castellano
(74) *Attorney, Agent, or Firm* — James L. Young; Westman, Champlin & Koehler, P.A.

(57) ABSTRACT

A hand-held vessel has a bottom wall, a sidewall and a supportive strap attached to the bottom wall and the sidewall. The bottom wall and sidewall have an inner and outer surface. The sidewall extends from the bottom wall, whereby the inner surfaces of the bottom wall and sidewall define a cavity for holding fluids or loose materials therein. The strap has a first end and a second end, whereby the first end is fixedly attached to the sidewall and the second end is selectively secured to the bottom wall. The strap is adaptable to accept a user's hand disposed between the strap and the outer surface of the sidewall. The strap urges the hand against the outer surface of the sidewall to secure the vessel to the hand and stabilize the vessel with respect to movement relative to the hand.

20 Claims, 11 Drawing Sheets

HAND-HELD VESSEL WITH ADJUSTABLE STRAP

CROSS-REFERENCE TO RELATED APPLICATIONS(S)

The present application is a continuation of U.S. patent application. Ser. No. 12/685,266, filed Jan. 11, 2010, now U.S. Pat. No. 8,556,116 which is a continuation of U.S. patent application Ser. No. 11/085,457, filed Mar. 21, 2005 which issued as U.S. Pat. No. 7,644,835, on Jan. 12, 2010, which is a division of U.S. patent application Ser. No. 10/370,691 filed Dec. 8, 2003, and issued as U.S. Pat. No. 6,991,829 which is a divisional of U.S. patent application Ser. No. 10/730,691, and issued as U.S. Pat. No. 6,991,829, which is a divisional of application Ser. No. 09/961,090 filed Sep. 21, 2001, and issued as U.S. Pat. No. 6,708,838, which claims priority from Provisional Application No. 60/234,617 filed Sep. 22, 2000, Provisional Application No. 60/262,165 filed Jan. 16, 2001 and Provisional Application No. 60/287,332 filed Apr. 30, 2001. The contents of these are hereby incorporated by reference in their entireties.

BACKGROUND OF THE INVENTION

This invention relates to holding vessels and more particularly to a hand-held container with a supportive strap adaptable to affirmatively engage a user's hand to the container.

Hand-held vessels, containers, or trays are utilized for carrying a variety of materials or fluids. Typically, a handle is provided, which allows a user to carry or hold the container without the user contacting the fluid therein. This is particularly beneficial in the case when the fluid is toxic or hazardous to a person's skin. A portable, hand-held container is useful in many commercial or household applications, and is especially useful in painting applications.

In the field of painting, there has long been a problem as to how to comfortably hold and carry a quantity of paint and a paintbrush for an extended period of time and on a unstable surface, such as while climbing a ladder, working off of a scaffold, or while standing on the roof of a building. One approach to this problem has been to use a light-weight paper bucket capable of holding around a gallon of paint. These buckets, however, have no handle and must be gripped with the thumb and fingers by the rim and side, which is tiring, or they must be cradled against a user's body (e.g., in the crook of a user's arm) which is awkward and inconvenient. Another approach to the problem is to use a metal or plastic bucket with a bail-type handle as disclosed in U.S. Pat. No. 3,595,431 to Bird. This approach, while affording a more versatile mode of holding a paint bucket, is awkward for dipping a paintbrush into the paint when the bucket is being suspended from the handle since the user's hand tends to be in the way. An alternative approach, as disclosed in U.S. Pat. No. 4,927,046 to Armstrong, is to support the paint container with the fingers of the user's hand in a compartment provided in the bottom of the container, and to hook the user's thumb into the handle. A similar approach disclosed in U.S. Pat. No. 4,164,299 to Fuhr shows a paint tray supported with the user's fingers in a compartment in the bottom of the tray while the thumb stabilizes the tray on a tab portion of the tray. These alternative approaches do not sufficiently stabilize the paint container with respect to the user's hand, thereby increasing the likelihood of inadvertently spilling paint during the painting process. In addition, these approaches tend to cause undue muscle fatigue in the fingers which support the paint container.

The Trim & Cut-in Cup, manufactured by Aqua-Tainer Co. of Shorewood, Ill., is a plastic paint container with a rigid handle attached to the container. The container is supported by grasping the handle or by slipping a user's hand under the rigid handle. In this latter approach, the rigid structure of the handle merely slips over the hand, and does not secure the container to the user's hand, which would serve to prevent inadvertent spilling of paint and muscle fatigue in the hand and fingers. In addition, the rigid handle does not accommodate different sizes of hands. If a user's hand is small, the user must grip the container with his or her hand to support the container. If a user's hand is large, the rigid handle may not allow the hand to fit under it, thus requiring the user to grip the rigid handle of the container in order to hold the container upright.

The known prior art hand-held containers are difficult to hold in close proximity to the user's other hand or work area without exerting considerable effort. None of the prior art containers offer a comfortable, stable and secure hand-held container for carrying, holding, and transferring fluids or other loose materials, without exerting considerable effort.

BRIEF SUMMARY OF THE INVENTION

The present invention is a hand-held vessel comprising a bottom wall, a sidewall, and a strap. The bottom wall has an inner surface and an outer surface. The sidewall extends from the bottom wall, and has an inner surface and an outer surface, where the inner surfaces of the bottom wall and the sidewall define a fluid holding cavity. The strap has a first end and a second end, where the first end is connected to the outer surface of the sidewall and the second end is connectable to the outer surface of the bottom wall.

In one embodiment, the present invention is characterized as a hand-held vessel comprising a bottom wall, a sidewall, and a strap. The bottom wall has an inner surface and an outer surface. The sidewall comprises an upper sidewall portion and a lower sidewall portion. The upper sidewall portion extends from the bottom wall in a first direction. The upper sidewall portion has an inner surface and an outer surface, where the inner surfaces of the bottom wall and the upper sidewall portion define a fluid holding cavity. The lower sidewall portion extends from the bottom wall in a second direction substantially opposite of the first direction. The strap has a first end and a second end, where the first end is connected to the outer surface of the upper sidewall portion and the second end is connectable to the outer surface of the bottom wall.

In an alternative embodiment, the present invention is characterized as a hand-held vessel comprising a bottom wall, a sidewall, and a strap. The bottom wall has an outer surface. The sidewall has a first portion and a second portion. The first portion extends from the bottom wall in a first direction. The second portion extends from the bottom wall in a second direction substantially opposite the first direction, where the second portion defines a cutout. The strap has a first end and a second end, where the first end is connected to the first portion of the sidewall and the second end is receivable in the cutout and is connectable to the outer surface of the bottom wall.

BRIEF DESCRIPTION OF THE DRAWINGS

The present invention will be further explained with reference to the attached figures, wherein like structure is referred to by like numerals throughout the several views.

While the above-identified drawing figures set forth several embodiments of the present invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION

Figure 1:
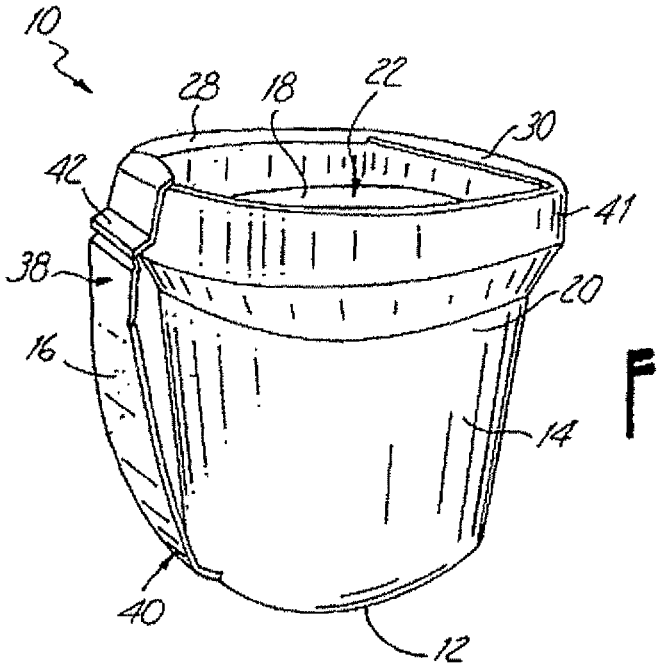
FIG. 1 is a perspective view of a hand-held vessel of the present invention.

As shown in FIG. 1, the present invention is a hand-held vessel 10 which includes a bottom wall 12, a sidewall 14 extending from the bottom wall 12, and a supportive strap 16 attached to either the bottom wall 12 or sidewall 14.

Figure 2:
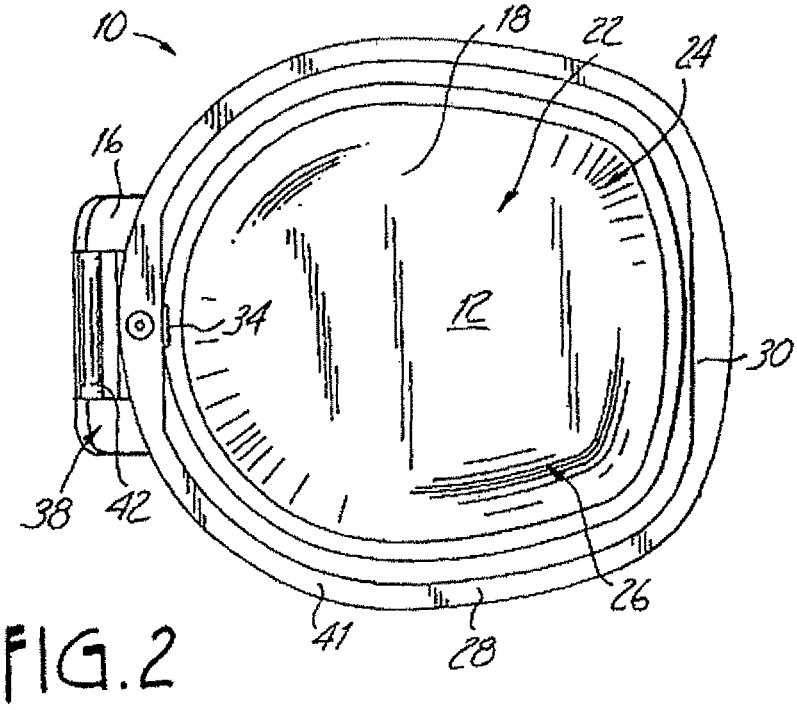
FIG. 2 is a top view of the vessel of FIG. 1.
Figure 3:
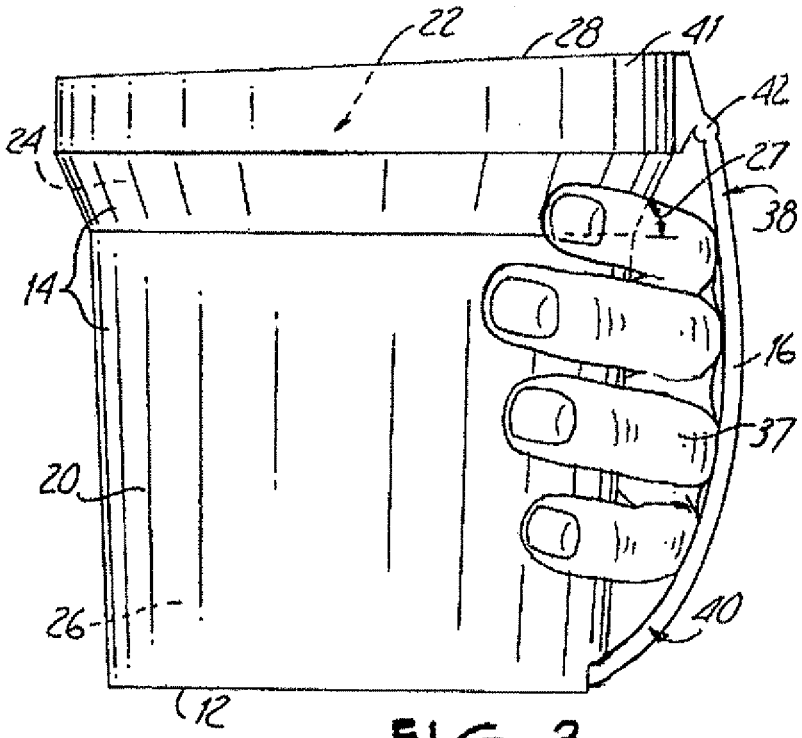
FIG. 3 is a side view of the vessel of FIG. 1, showing a user's hand between the strap and the outer surface of the sidewall thereof.

The bottom wall 12 and sidewall 14 have an inner surface 18 and an outer surface 20, whereby the inner surface 18 of the bottom wall 12 and sidewall 14 define a cavity 22 therein for carrying, holding or transporting loose materials or fluids. The bottom wall 12 and sidewall 14 are made of polypropylene (or other suitable plastic) to withstand the harmful effects of paint, stain or varnish. Typically, the sidewall 14 is continuous for containing a fluid, such as paint, stain, adhesive, or varnish. As shown in FIG. 2, the cavity 22 has an upper portion 24 and a lower portion 26, whereby the lower portion 26 is adjacent the inner surface 18 of the bottom wall 12. As shown, the upper portion 24 has a larger lateral cross-sectional dimension than the lower portion 26. The sidewall 14, shown in FIG. 3, is representative of the upper portion 24 of the cavity 22 having a larger cross-sectional dimension than the lower portion 26 of the cavity 22. The sidewall 14 forming the upper portion 24 of the cavity 22 is outwardly inclined at an angle 27 with respect to the bottom wall 12. When used as a painting container, the incline of the upper portion 24 causes paint on the inner surface 18 of the upper portion 24 of the cavity 22 to drip or slide downward from the upper portion 24 to the reservoir of paint contained within the cavity 22.

Figure 4:
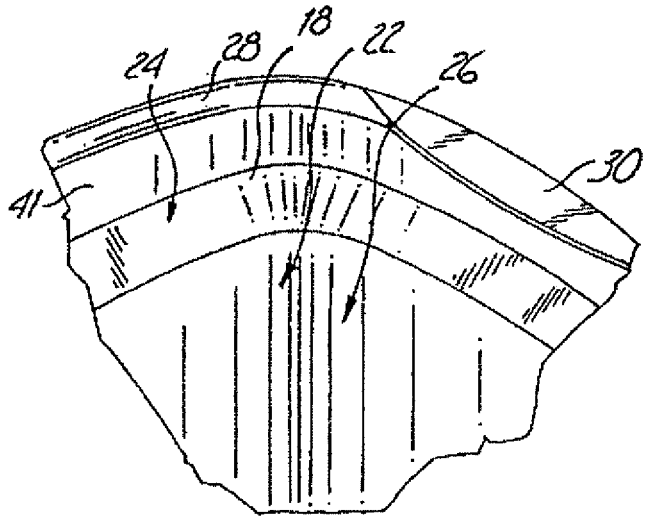
FIG. 4 is an enlarged perspective view of the rim portion of the vessel of FIG. 1, showing a scraping lip thereon.
Figure 5:
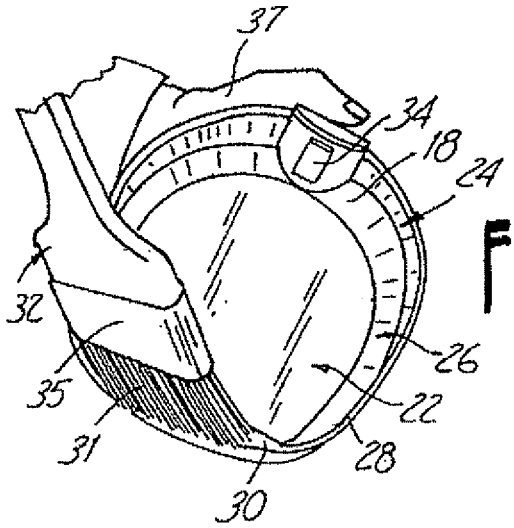
FIG. 5 is a perspective view of the vessel of FIG. 1, showing a user wiping a paintbrush on the scraping lip of the present invention.

As shown in FIG. 2, the sidewall 14 has a rim portion 28, which has a scraping lip 30 along a portion thereof and extending inwardly from the rim portion 28 toward the cavity 22. The scraping lip 30 is positioned opposite the strap 16, as shown in FIG. 2, but could be disposed anywhere along the rim portion 28. As shown in the enlarged view of the rim portion 28 shown in FIG. 4, the scraping lip 30 extends substantially perpendicular from the rim portion 28. The scraping lip 30 offers a somewhat linear edge to uniformly remove excess paint from a tool, such as a paintbrush 32, by stroking the bristles 31 of the paintbrush 32 against the scraping lip 30, as shown in FIG. 5.

Figure 6:
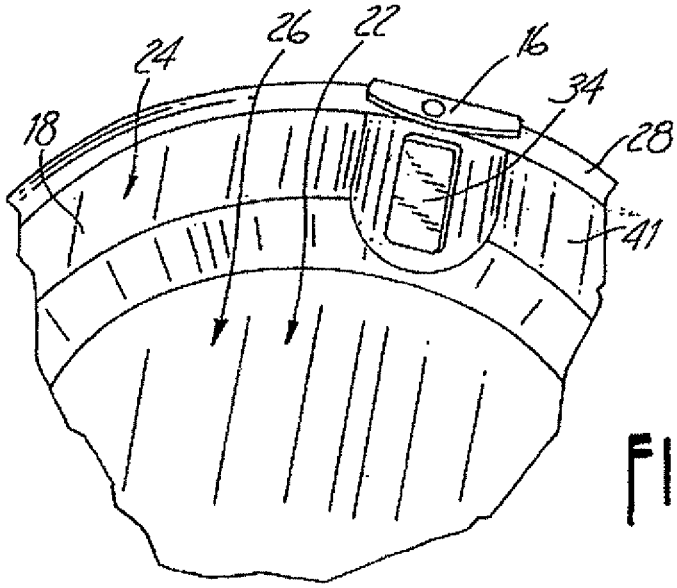
FIG. 6 is an enlarged perspective view of the rim portion of the vessel of FIG. 1, showing a magnet thereon.
Figure 7:
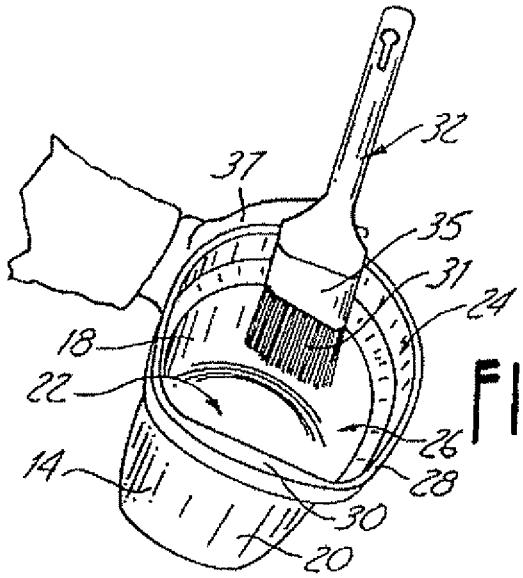
FIG. 7 is a perspective view of the vessel of FIG. 1, showing a paintbrush held in place by the magnet thereon.

The vessel 10 has a retainer for keeping the paintbrush 32 within the cavity 22 of the vessel 10. In one embodiment, as shown in the enlarged view of the rim portion 28 in FIG. 6, the retainer is at least one magnet 34 affixed to the inner surface 18 of the sidewall 14. The magnet is affixed in the upper portion 16 of the cavity 22 adjacent the strap 16. As depicted in FIG. 7, the magnet 34 releasably holds the paintbrush 32 via a metallic ferrule portion 35 of the paintbrush 32 with the bristles 31 of the paintbrush 32 disposed inside of the cavity 22 of the vessel 10, so that paint on the bristles 31 drips into the cavity 22. In another embodiment, the retainer is a notch in the rim portion 28 of the sidewall 14, which is formed to accommodate and even retain the handle of a paintbrush.

Figure 8:
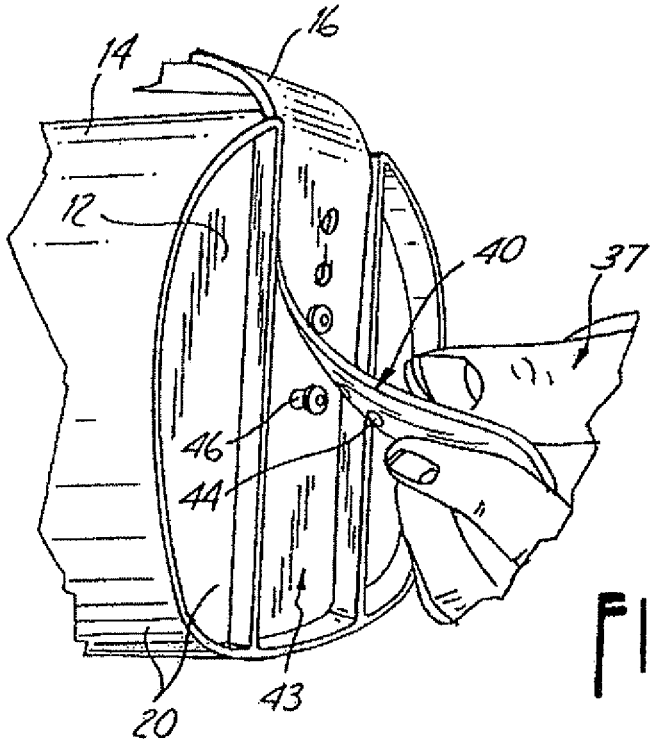
FIG. 8 is an enlarged bottom perspective view of the vessel of FIG. 1, showing a user selectively securing the strap to the outer surface of the bottom wall thereof.
Figure 9:
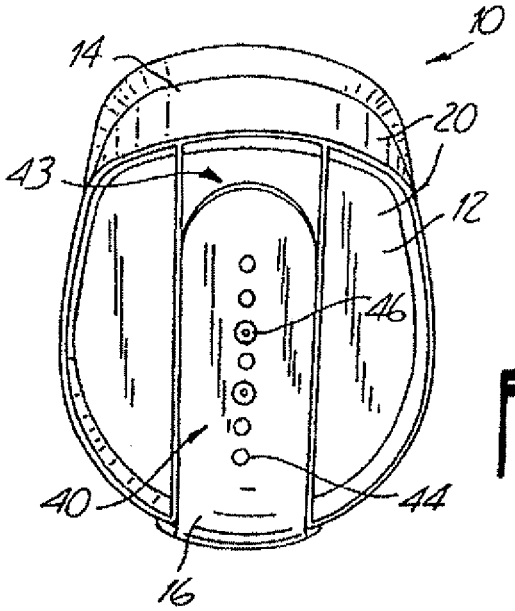
FIG. 9 is a bottom view of the vessel of FIG. 1, showing the strap secured to the outer surface of the bottom wall thereof.

The supportive strap 16 is attached to the bottom wall 12 and/or the sidewall 14 of the vessel 10. The strap 16 is adaptable to accept a user's hand 37 disposed between the strap 16 and the outer surface 20 of the sidewall 14, as shown in FIGS. 3, 5, 7, and 11. Alternatively, the strap is adaptable to accept a user's wrist, arm, or other appendage disposed between the strap 16 and the outer surface 20 of the sidewall 14. The strap is even adaptable to accept a user's belt (or other clothing item), a ladder, or any suitable structure disposed between the strap 16 and the outer surface 20 of the sidewall 14. The strap 16 urges the hand 37 against the outer surface 20 of the sidewall 14 to secure the vessel 10 to the hand 37 and stabilize the vessel 10 with respect to movement relative to the hand 37. The strap 16 has a first end 38 and a second end 40 whereby the first end 38 is fixedly attached to the sidewall 14 and the second end 40 is fixedly attached to the bottom wall 12, as shown in FIG. 3. In one embodiment, the strap 16 is integrally formed with an upper rim section 41 of the vessel 10, and is fixedly attached to the sidewall 14 by a living hinge 42 adjacent the first end 38 of the strap 16 thereof. The second end 40 of the strap 16 is selectively secured to the bottom wall 12 at discreet locations along the length of the second end 40 of the strap 16. As seen in FIG. 8, the outer surface 20 of the bottom wall 12 defines a groove 43 for receiving the second end 40 of the strap 16. The second end 40 of the strap 16 has at least one first engagement member 44 and the outer surface 20 of the bottom wall 12 has at least one second engagement member 46. In one embodiment, the first engagement member 44 is a hole and the second engagement member 46 is a protrusion extending from the outer surface 20 in the groove 43 of the bottom wall 12, wherein the first engagement member 44 mates with the second engagement member 46, as shown in FIG. 9. The length of the strap is thus adjustable among several pre-determined lengths.

In an optional embodiment, the second end 40 of the strap 16 is selectively secured to the bottom wall 12 at infinitely various locations along the length of the second end 40 of the strap 16. In the optional embodiment, the second end 40 has a first portion of a two-part mechanical fastener thereon and the bottom wall 12 has a second cooperative portion of the two-part mechanical fastener thereon. Examples of two part mechanical fasteners include (but are not limited to) hook and loop fasteners (such as Velcro™ fasteners) and headed stems (such as Dual-Lok fasteners). In another optional embodiment, the strap 16 is removable from one or both of the sidewall 14 and bottom wall 12. For example, if both the first and second ends 38, 40 of the strap 16 have two-part mechanical fastener portions (such as Velcro™ fasteners), the strap 16 can be removably mounted directly onto cooperative two-part mechanical fastener portions on the vessel 10. Alternatively, if both the first and second ends 38, 40 of the strap 16 have a two-part mechanical fastener portion and a cooperative two-part mechanical fastener portion (such as Velcro™ fasteners) on one side of each of their respective ends 38, 40, the strap 16 can be removably mounted to the vessel 10 by a suitable structure such as strap holding rings (not shown) on the bottom wall 12 and the sidewall 14. The strap 16 is removably mounted to the vessel by looping the first end 38 around the strap holding ring on the sidewall 14 and looping the second end 40 around the strap holding ring on the bottom wall 12 and then securing the two part mechanical fasteners together at each end 38, 40 respectively. In these embodiments, the strap 16 may or may not be adjustable in length.

Figure 10:
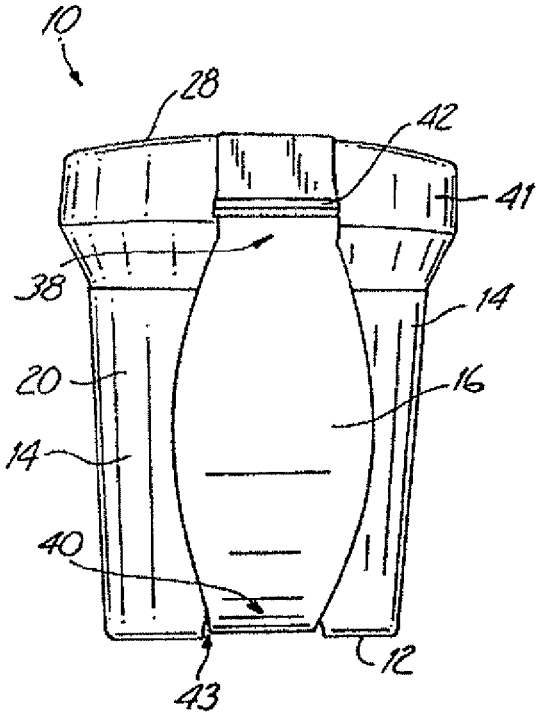
FIG. 10 is a rear view of the vessel of FIG. 1.

In one embodiment, a portion of the strap 16 has elastic characteristics to provide comfort to the user's hand 37 by conforming to the shape of the hand and to help urge the hand 37 against the outer surface 20 of the sidewall 14. The strap 16 is made of a low durometer, stretchy Thermoplastic Elastomer (T.P.E.), such as Santoprene, rubber, or other elastic material. In addition, as shown in FIG. 10, the strap 16 is widened along its length to disburse the pressure exerted by the strap 16 on the hand 37 over a larger area of the hand 37. In all possible embodiments, the strap may be elastic along its entire operative length, or merely elastic in part.

In use, a user aligns his or her hand 37 between the strap 16 and the outer surface 20 of the vessel 10. The user secures the second end 40 of the strap 16 to the container so that the strap 16 urges the hand 37 against the outer surface 20 of the vessel 10, thereby stabilizing the vessel 10 with respect to movement relative to the hand 37. The length of the strap 16 is adjustable by positioning the second end 40 of the strap 16 relative to the vessel 10. Alternatively, the first and second ends 38, 40 of the strap 16 are secured to the vessel 10, thereby defining a passage for receiving a user's hand 37 between the strap 16 and the outer surface 20 of the vessel 10. The user then inserts his or her hand 37 into the passage until the elastic portion or portions of the strap 16 stretch to a degree sufficient to allow entry of the hand into the passage. The stretched strap 16 thus urges the hand 37 against the outer surface 20 of the vessel 10.

Figure 11:
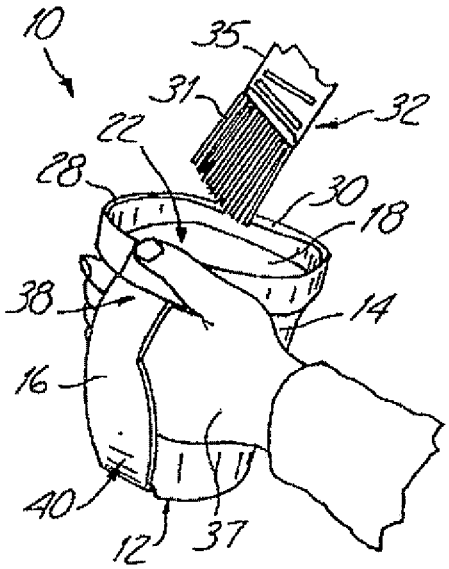
FIG. 11 is a perspective view of the vessel of FIG. 1, with a user's hand affixed to the vessel, and showing a user inserting a paintbrush into the vessel.

The process of applying a fluid, such as paint, to a desired surface begins by pouring paint into the cavity 22 of the vessel 10. With the first end 38 of the adjustable strap 16 fixedly attached to the vessel 10, the user aligns his or her hand 37 between the strap 16 and the outer surface 20 of the vessel 10. The second end 40 of the strap 16 is then secured to the vessel 10 so that the strap 16 urges the hand 37 against the outer surface 20 of the vessel 10 and stabilizes the vessel 10 with respect to movement relative to the hand 37. As shown in FIG. 11, a user inserts a tool, such as the paintbrush 32, into the paint held within the vessel 10 until the bristles 31 of the paintbrush 32 are in the paint. Upon removal of the bristles 31 from the paint, the user may wipe the bristles 31 of the paintbrush 32 across the scraping lip 30 before applying the paint. The user then applies the paint with the bristles 31 of the paintbrush 32 to the desired surface.

The invention provides a convenient, stable, secure and effortless way to hold a vessel. The user does not need to grip the strap 16 or the sidewall 14 of the vessel 10 because the strap 16 urges the user's hand 37 (as shown, the user's palm) against the outer surface 20 of the sidewall 14. The user can grip the sidewall 14 or can merely relax his or her hand during use of the vessel, knowing that the vessel 10 is securely fastened to that hand. Thus, the invention greatly reduces fatigue in the holding hand and fingers of a user.

Figure 12:
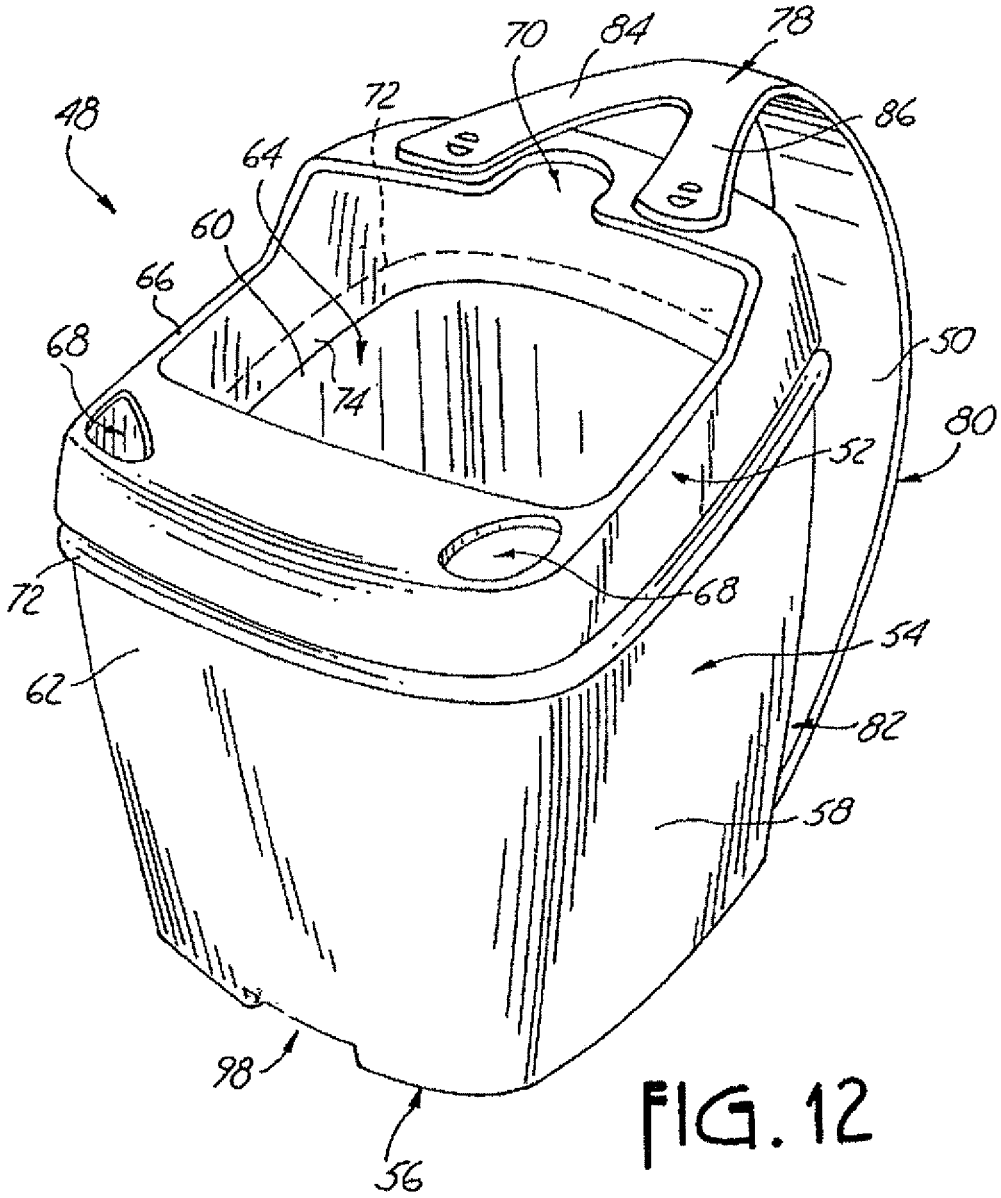
FIG. 12 is an enlarged perspective view of a first alternative embodiment of the hand-held vessel of the present invention.
Figure 13:
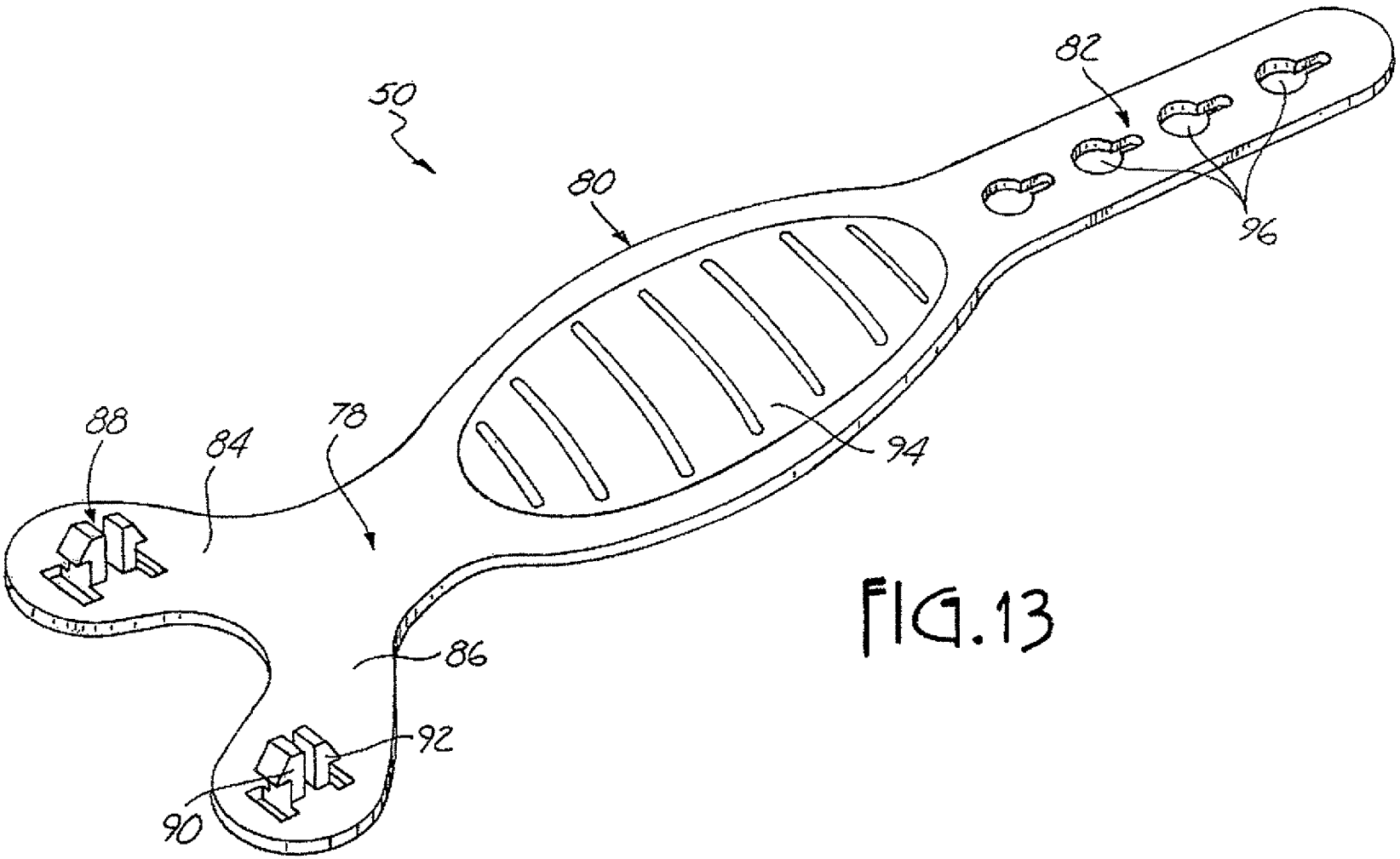
FIG. 13 is a perspective view of a strap which is adapted to be removably attached to the first alternative embodiment of the vessel of FIG. 12.
Figure 14:
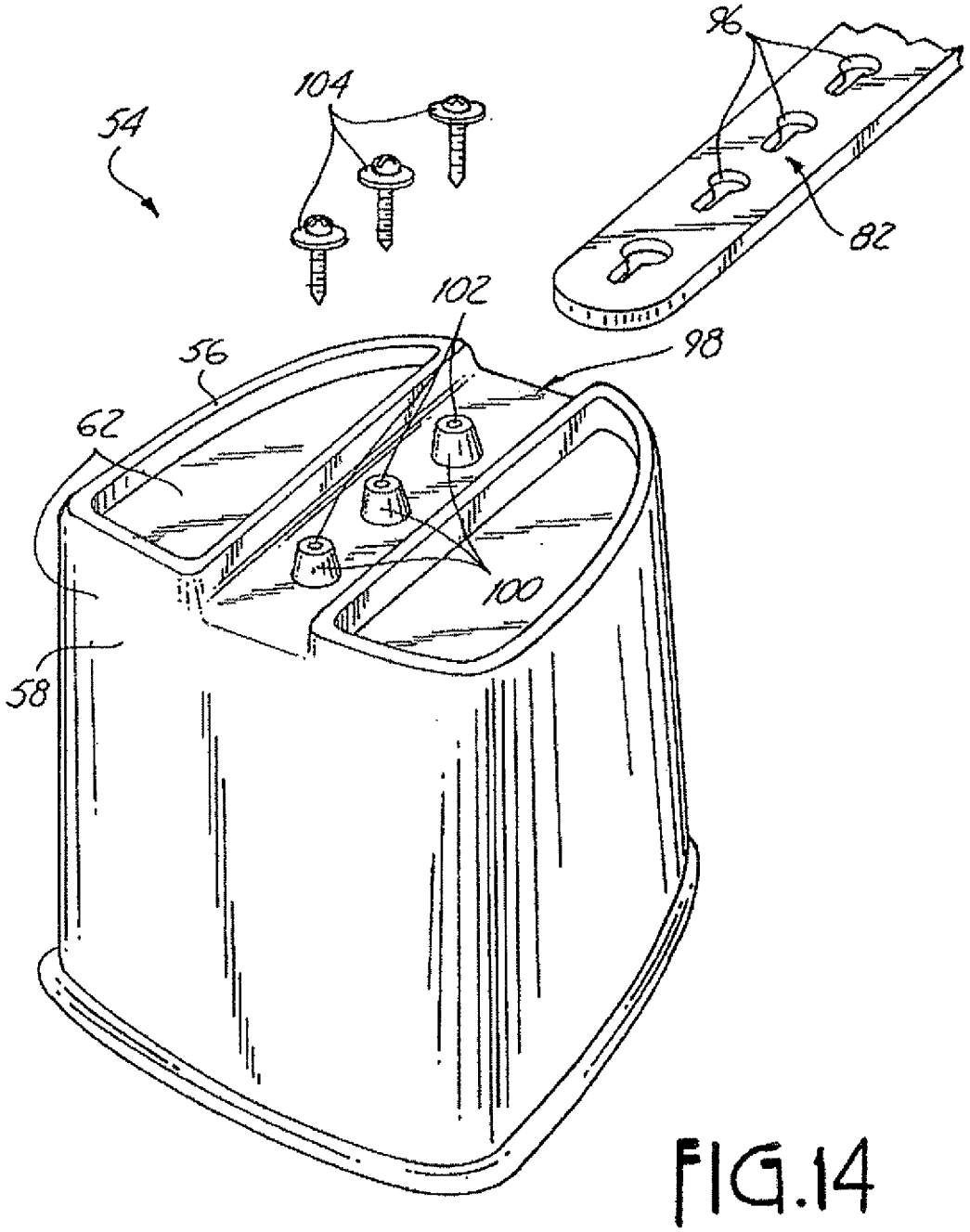
FIG. 14 is a bottom perspective view of the bottom wall and the strap of the first alternative embodiment of the vessel of FIG. 12.

An alternative embodiment of the present invention is a container 48 shown in FIGS. 12-14. A strap 50 is provided for selected attachment to a container 48 having a top portion 52 and a bottom portion 54. The bottom portion 54 has a bottom wall 56 and a sidewall 58. The bottom wall 56 and sidewall 58 have an inner surface 60 and an outer surface 62, whereby the inner surface 60 of the bottom wall 56 and sidewall 58 define a cavity 64 for holding paint therein. The top portion 52 and bottom portion 54 are made of polypropylene (or other suitable plastic) to withstand the harmful effects of paint, stain or varnish.

The top portion 52 acts as a lid to partially cover the bottom portion 54. The top portion 52 has a rim portion 66 defining an opening to the cavity 64 to allow a user to access the paint contained therein. The rim portion 66 may also have one or more pouring spouts 68 formed thereon to aid in emptying the contents of the container 48. The rim portion 66 has a retaining means, such as a magnet (not shown) and/or a notch 70 formed therein which is adapted to fit most tool handles, such as a paintbrush handle, while the tool is in the container 48. The top portion 52 has an outer lip 72 to form fit with a top edge of the sidewall 58 to seal the top portion 52 with the bottom portion 54, via either a snap fit or by sonic weld engagement, and the sidewall 58 has a corresponding lip (not shown) for engagement with the outer lip 72 of the top portion 52. The top portion 52 also has an inner lip 74 to prevent the fluid in the bottom portion 54 from escaping through the joint formed by the top and bottom portions 52, 54 and from dripping on the outside of container 48. The top portion 52 also has engagement means for engagement with the strap 50. Typically, the top portion 52 has holes 76 on either side of the notch 70 therethrough for engagement with the strap 50.

As shown in FIG. 13, the strap 50 has a first end 78, a central hand portion 80, and a second end 82, whereby the first end 78 is removably engageable to the top portion 52 and the second end 82 is removably engageable to the bottom portion 54. As shown in FIG. 13, the first end 78 has a first engagement end 84 and a second engagement end 86 forming a "Y". The Y-shape of the first end 78 allows clearance for the notch 70 in the top portion 52 to accept tool handles. Each engagement end 84, 86 has engagement means 88, which are typically a pair of snap pins 90, 92 that snap into the holes 76 of the top portion 52 to secure the strap 50 to the top portion 52. The central hand portion 80 is enlarged (widened) and has a molded or added texture portion 94 for aligned contact with the user's hand. The strap 50 has both its ends attached to the container 48 and the user slips his or her hand under the strap 50 so that the strap 50 urges the hand against the outer surface 62 of the container 48. The second end 82 has engagement means for engagement with the bottom portion 54 of the container 48. As shown in FIG. 13, the engagement means is, in one embodiment, defined by a plurality of holes 96, such as keyhole-shaped holes for engagement with the bottom portion 54. The bottom portion 54 has engagement means for engaging with the second end 82 of the strap 50. As shown in FIG. 14, the outer surface 62 of the bottom wall 56 defines a groove 98 with a plurality of raised protrusions 100. Optionally, the protrusions 100 have holes 102 for receiving threaded fasteners 104, such as self-tapping washer head screws. The keyhole-shaped holes 96 of the second end 82 are shaped to engage with the raised fasteners/protrusions of the bottom wall 56. The holes 96 are placed over the fasteners 104, and then optionally secured thereto. The length of the strap 50 may be adjusted by varying its alignment along the fasteners 104. The strap 50 is can be made of a low durometer, stretchy Thermoplastic Elastomer (T.P.E.), such as Santoprene, rubber, or other elastic material.

In addition to the fastener/keyhole and snap pin/hole arrangements disclosed, a variety of fastening arrangements are possible to removably and adjustably secure the strap 50 to the top portion 52 and the bottom portion 54 of container 48 and to adjust the size of the strap 50. Examples of such fastening means include (but are not limited to) buttons, two-part mechanical fasteners, such as hook and loop fasteners and Dual-Lok fasteners, belt type fasteners, or any shaped fastener for engagement through a cooperative hole.

Figure 15:
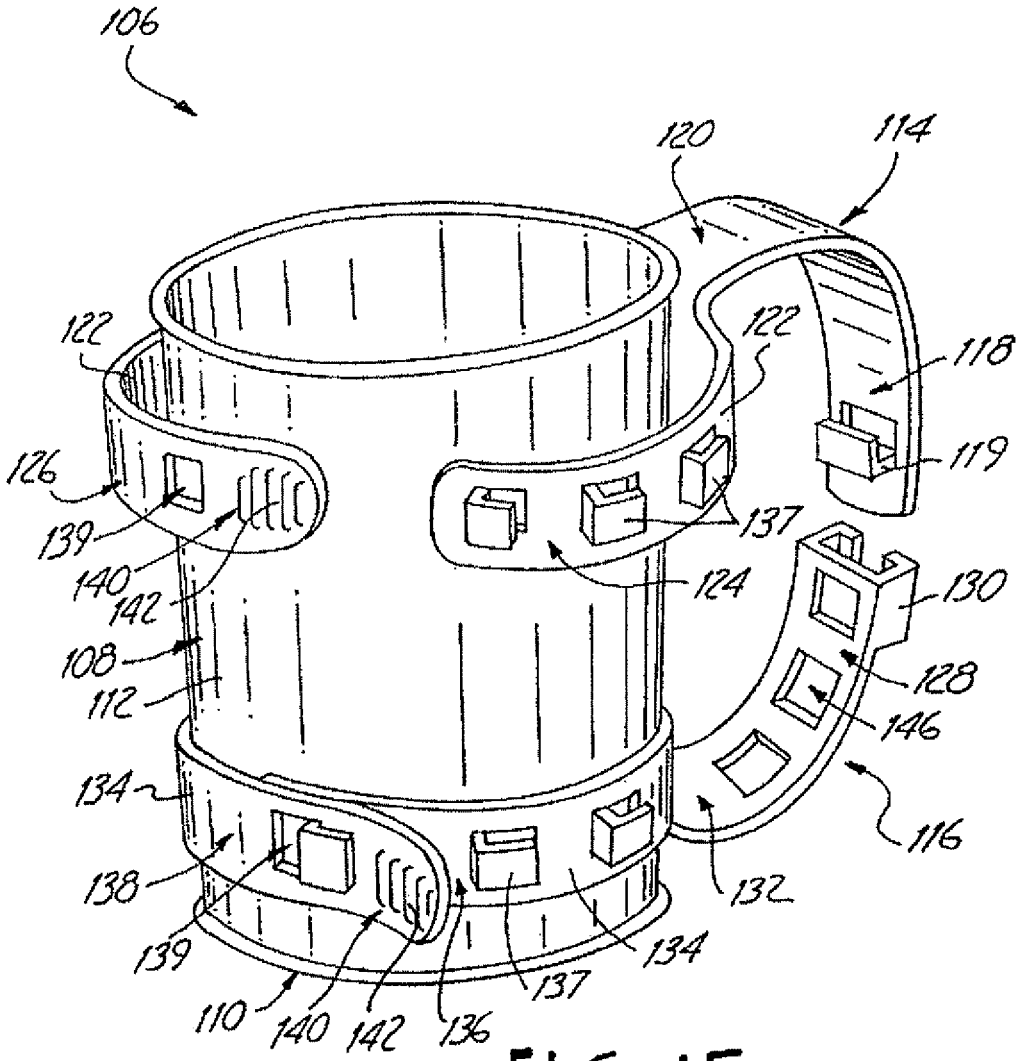
FIG. 15 is a perspective view of a second alternative embodiment of the hand-held vessel of the present invention, which has a strap which is removably attachable to a container.

Another alternative embodiment of the invention is a removable and adjustable strap 106, shown in FIG. 15. The strap 106 can be easily attached and removed from various items, such as a hand-held container 108. The strap 106 is designed so that the user can grip the strap 106 itself or slide his or her hand between the container 108 and the strap 106. The strap 106 is adjustable for different hand sizes or to secure the hand (i.e., the palm) tightly against the container 108.

As shown in FIG. 15, the adjustable strap 106 is attached to a container 108 having a bottom wall 110 and a sidewall 112. The adjustable strap 106 has an upper portion 114 and a lower portion 116. The upper portion 114 has a first fastener end 118 with a hook 119 thereon and a second container end 120 with a securing strap 122 thereon. The securing strap 122 has a hook end 124 and a receiving end 126 for removably and adjustably securing the upper portion 114 around the sidewall 112 of the container 108. The lower portion 116 has a first fastener end 128 with a hook receptacle 130 and a second container end 132 with a securing strap 134 thereon. The securing strap 134 has a hook end 136 and a receiving end 138 (similar to the upper portion securing strap) for removably and adjustably securing the lower portion 116 around the sidewall 112 of the container 108. The hook ends 124, 136, have a plurality of hooks 137 thereon adapted for engagement through holes 139, in the receiving ends 126, 138, respectively. Gripping tabs 140 having raised ridges 142, are located distally on the receiving ends 126, 138, of the securing straps 122, 134, respectively, to help the user to pull and stretch each securing strap 122, 134 tight as it is wrapped around the sidewall 112 of the container 108.

The upper portion 114 and lower portion 116 are removably connected together to form a hand grip portion. The hook 119 on the upper portion fastener end 118 engages with the hook receptacle 130 on the lower portion fastener end 120. Once inserted through the hook receptacle 130, the hook 119 is engageable through one of a plurality of holes 146 located on the fastener end 128, to adapt the strap 106 to a desired shape and length. Alternatively, the upper portion fastener end 118 may also have a plurality of hooks 119 to adjust the size of the hand grip portion to fit a variety of hand sizes. The user slips his or her hand under the strap 106 with the palm facing and contacting the container 108. With this embodiment, the novel means of affixing a hand to a container is possible with any generic container. The hand (i.e., palm) is urged against an outer surface of the container, and the container is fixedly secured to the hand.

The inventive adjustable strap has additional optional embodiments. In the embodiment shown in FIG. 15, the grip portion and securing straps are both adjustable. In an optional embodiment, the strap has a non-adjustable hand grip portion with removable and adjustable container securing straps. Another embodiment combines non-adjustable securing straps with an adjustable hand grip portion. Another embodiment includes more than two securing straps, and in yet another embodiment, only one securing strap is provided. In another embodiment, a plurality of hand grip portions are provided in combination with one or more securing straps. The inventive adjustable strap is made of a low durometer, stretchy Thermoplastic Elastomer (T.P.E.), such as Santoprene, but may also be made from a variety of elastic materials.

The inventive adjustable strap is not limited to the hook and hole fastening scheme shown in FIG. 15. A variety of fastening arrangements are possible to removably and adjustably secure the securing straps, to the container and to adjust the size of the hand grip portion. Examples of such fastening means include (but are not limited to) buttons, two-part mechanical fasteners, such as hook and loop fasteners and Dual-Lok fasteners, belt type fasteners, or any shaped fastener for engagement through a cooperative hole.

Figure 16:
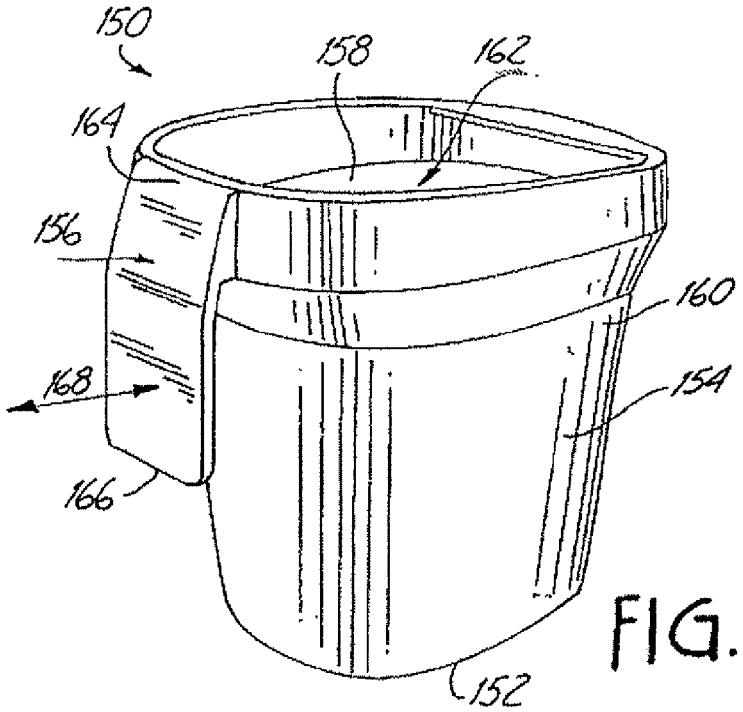
FIG. 16 is a perspective view of a third alternative embodiment of the hand-held vessel of the present invention.
Figure 17:
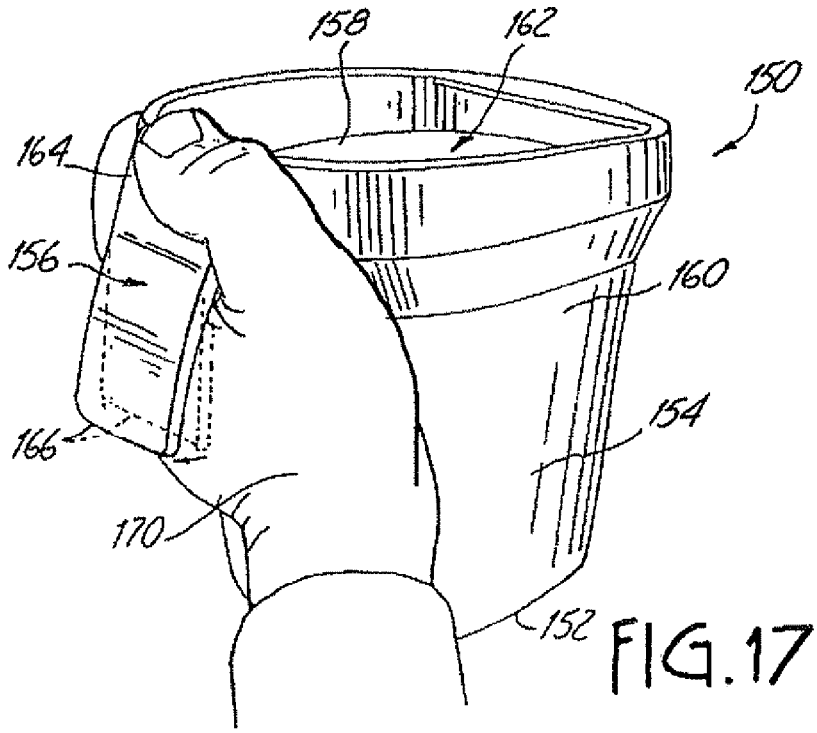
FIG. 17 is a perspective view showing a user's hand between the strap and the outer surface of the sidewall thereof of the third alternative embodiment of the vessel of FIG. 16.
Figure 18:
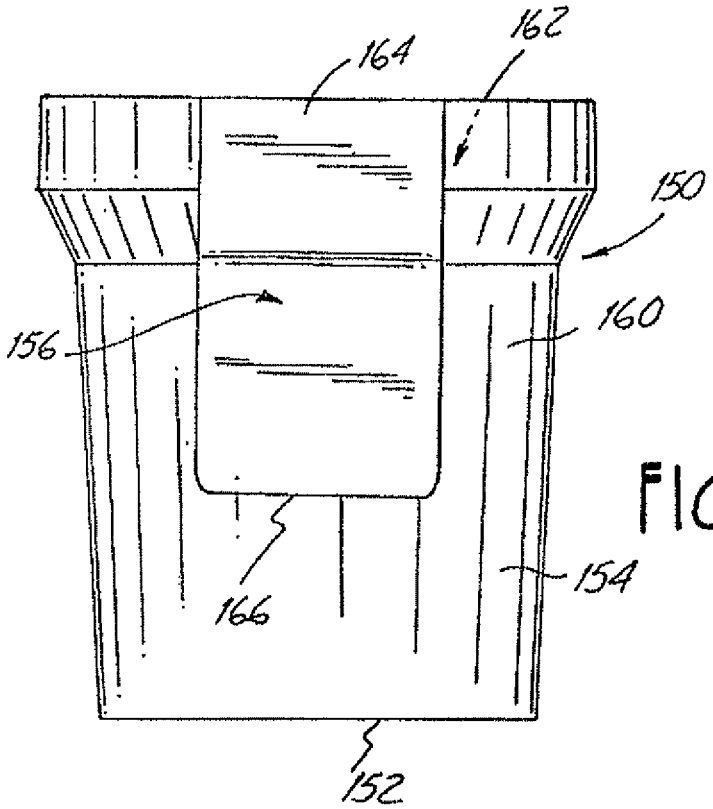
FIG. 18 is a rear view of the third alternative embodiment of the vessel of FIG. 16.

Another alternative embodiment of the present invention is shown in connection with vessel 150 in FIGS. 16-18. The vessel 150 includes a bottom wall 152, a sidewall 154 extending from the bottom wall 152, and a supportive strap 156 attached to the sidewall 154.

The bottom wall 152 and sidewall 154 have an inner surface 158 and an outer surface 160, whereby the inner surface 158 of the bottom wall 152 and sidewall 154 define a cavity 162 therein for carrying, holding or transporting loose materials or fluids. The strap 156 has first end 164 and a second end 166, and either the first end 164 or second end 166 is secured to the outer surface 160 of the vessel 150 to permit resilient movement of at least a portion of the strap 156 toward and away from the vessel 150 in the direction of arrows 168. As shown in FIG. 17, the user's hand 170 is inserted between the strap 156 and the outer surface 160 of the vessel 150 to a degree sufficient to move that portion of the strap 156 away from the vessel 150, whereby the strap 156 resiliently urges the hand 170 against the outer surface 160 of the vessel 150. The strap 156 is resiliently deformable relative to the vessel 150, and thus is capable of accommodating a variety of hand sizes.

FIG. 18 is a side view of the vessel 150, and although the strap 156 is shown with a uniform width, the strap 156, as well as the second end 166, could assume a variety of shapes, such as circular or hemispherical shapes. In this embodiment, the vessel 150 and strap 156 may be separate components bonded together, or may be formed integrally. In either event, the material used (at least for the strap) must be sufficiently resilient to flex upon hand insertion, as per FIG. 17.

In all disclosed combinations, this invention provides a lightweight and adjustable strap for a wide range of containers. Preferably, the strap is made of a low durometer, stretchy Thermoplastic Elastomer (T.P.E.), such as Santoprene, but may also be made from a variety of elastic materials. The present invention provides an extremely easy and effortless way to hold a container. Its application is not limited merely to fluid containers, but may be applied to any hand-held device.

Although the present invention has been described with reference to preferred embodiments, workers skilled in the art will recognize that changes may be made in form and detail without departing from the spirit and scope of the invention.

The invention claimed is:

1. A hand-held paint pail for painting applications, the hand-held paint pail comprising:

a bottom wall;

a sidewall comprising:

an upper part extending upwardly from the bottom wall, wherein the upper part of the sidewall and the bottom wall collectively define an inner cavity for holding paint;

a base part extending downwardly from the bottom wall such that the bottom wall is upwardly recessed from a horizontal surface when the hand-held paint pail stands upright on the horizontal surface; and a rear opening in the base part of the sidewall that provides access to the upwardly-recessed bottom wall from a rear side of the sidewall; and a strap having a first end and a second end, wherein the first end is connected to the upper part of the sidewall, and wherein the second end is receivable through the rear opening and is connectable to the bottom wall at multiple discrete locations along a length of the second end of the strap such that the strap is adjustable in length.

2. The hand-held paint pail of claim 1, wherein the second end of the strap is connectable to a plurality of locations along the bottom wall.

3. The hand-held paint pail of claim 2, wherein the bottom wall comprises one or more protrusions, and wherein the multiple discrete locations along the length of the second end of the strap a plurality of holes engagable with the one or more protrusions.

4. The hand-held paint pail of claim 1, wherein the strap is configured to accept a user's hand disposed between the strap and the sidewall to stabilize the paint pail with respect to movement relative to the user's hand.

5. The hand-held paint pail of claim 4, wherein the strap is configured to accept the user's hand in a manner such that a thumb of the user's hand is positioned outside of the strap at the upper part of the sidewall.

6. The hand-held paint pail of claim 1, wherein the upper part of the sidewall includes an upper portion and a lower portion, and wherein the upper portion is inclined outwardly at an angle relative to the lower portion.

7. The hand-held paint pail of claim 1, and further comprising a magnet secured to the upper part of the sidewall at a location within the cavity.

8. The hand-held paint pail of claim 1, and further comprising a pair of ribs extending along at least a portion of the bottom wall to define a recessed groove that intersects the rear opening.

9. A hand-held paint pail for painting applications, the hand-held paint pail comprising:

a bottom wall having an inner surface and an outer surface;

an upper sidewall part extending from the bottom wall in a first direction, the upper sidewall part having an inner surface and an outer surface, wherein the inner surfaces of the bottom wall and the upper sidewall part collectively define a cavity for holding paint; and a base sidewall part extending from the bottom wall in a second direction substantially opposite of the first direction to define a recessed region below the outer surface of the bottom wall;

a rear opening at the base sidewall part that provides access to the recessed region from a rear side of the base sidewall part; and a strap having a first end and a second end, wherein the first end is connected to the outer surface of the upper sidewall part, and wherein the second end is receivable through the rear opening, and comprise a plurality of holes that are connectable to the outer surface of the bottom wall.

10. The hand-held paint pail of claim 9, wherein the strap is configured to accept a user's hand disposed between the strap and the upper sidewall part to stabilize the paint pail with respect to movement relative to the user's hand.

11. The hand-held paint pail of claim 9, wherein the plurality of holes of the second end of the strap are connectable to a plurality of locations along the outer surface of the bottom wall.

12. The hand-held paint pail of claim 9, wherein the outer surface of the bottom wall comprises one or more protrusions, and wherein the plurality of holes of the second end of the strap comprises are engagable with the one or more protrusions.

13. The hand-held paint pail of claim 9, and further comprising a magnet secured to the upper sidewall part at a location within the cavity.

14. The hand-held paint pail of claim 9, and further comprising a pair of ribs extending along at least a portion of the bottom wall to define a recessed groove that intersects the rear opening.

15. A hand-held paint pail for painting applications, the hand-held paint pail comprising:

a bottom wall having an outer surface and one or more protrusions extending from the outer surface of the bottom wall;

a top opening that as a cross-sectional area that is larger than a cross-sectional area of the bottom wall;

a sidewall comprising:

an upper part extending from the bottom wall in a first direction to the top opening;

a base part extending from the bottom wall in a second direction substantially opposite the first direction to define a recessed region below the outer surface of the bottom wall; and a rear opening in the base part of the sidewall that provides access to the recessed region from a rear side of the sidewall; and a strap having a first end and a second end, wherein the first end is connected to the upper sidewall part adjacent to the top opening, and wherein the second end is receivable through the rear opening, and comprises a plurality of holes engagable with the one or more protrusions of the outer surface of the bottom wall.

16. The hand-held paint pail of claim 15, wherein the strap is configured to accept a user's hand disposed between the strap and the upper part of the sidewall to stabilize the paint pail with respect to movement relative to the user's hand.

17. The hand-held paint pail of claim 16, wherein the strap is configured to accept the user's hand in a manner such that a thumb of the user's hand is positioned outside of the strap.

18. The hand-held paint pail of claim 15, wherein the upper part of the sidewall includes an upper portion and a lower portion, and wherein the upper portion is inclined outwardly at an angle relative to the lower portion.

19. The hand-held paint pail of claim 15, wherein the outer surface of the bottom wall defines a groove for receiving the second end of the strap, wherein the groove intersects with the cutout.

20. The hand-held paint pail of claim 15, and further comprising a magnet secured to the upper part of the sidewall adjacent to the top opening.

* * * * *